United States Patent [19]

Buschor

[11] Patent Number: 5,022,590

[45] Date of Patent: Jun. 11, 1991

[54] SPRAY GUN FOR ELECTROSTATIC SPRAY COATING

[75] Inventor: Karl Buschor, St. Gallen, Switzerland

[73] Assignee: Ransburg-Gema AG, St. Gallen, Switzerland

[21] Appl. No.: 475,108

[22] Filed: Feb. 5, 1990

[30] Foreign Application Priority Data

Feb. 14, 1989 [DE] Fed. Rep. of Germany ..... 3904437

[51] Int. Cl.[5] ..... B05B 5/25; B05B 15/00

[52] U.S. Cl. ..... 239/708; 239/526; 239/390

[58] Field of Search ..... 239/690, 704, 708, 390, 239/525, 526, 707; 222/394, 399

[56] References Cited

U.S. PATENT DOCUMENTS

| | | | |
|---|---|---|---|
| 3,382,091 | 5/1968 | Drum | 239/707 |
| 3,583,632 | 6/1971 | Shafter | 239/15 |
| 3,844,477 | 10/1974 | Pollard et al. | 239/706 |
| 4,779,804 | 10/1988 | Baba et al. | 239/690 |

FOREIGN PATENT DOCUMENTS

| | | |
|---|---|---|
| 100854A1 | 2/1984 | European Pat. Off. . |
| 2025081 | 12/1970 | Fed. Rep. of Germany . |
| 2030388 | 1/1971 | Fed. Rep. of Germany . |
| 2055936 | 5/1972 | Fed. Rep. of Germany . |
| 2264386 | 5/1973 | Fed. Rep. of Germany . |
| 2851006 | 6/1979 | Fed. Rep. of Germany . |
| 2908009 | 9/1979 | Fed. Rep. of Germany . |
| 8214363.3U1 | 9/1982 | Fed. Rep. of Germany . |
| 3507965C1 | 4/1986 | Fed. Rep. of Germany . |
| 3545885C1 | 1/1987 | Fed. Rep. of Germany . |
| 8802221.8U1 | 6/1988 | Fed. Rep. of Germany . |

OTHER PUBLICATIONS

DE-journal, "Kunststoff-Berater", 10/1969, p. 832.

*Primary Examiner*—Andres Kashnikow
*Assistant Examiner*—Lesley D. Morris
*Attorney, Agent, or Firm*—Barnes & Thornburg

[57] ABSTRACT

The gun grip (18) and the gun barrel (2) are two bodies that are detachably connected with each other. The fluid line (26) is a stiff tube with two tubular shanks (27, 28) which at said angle extend obliquely to each other. The one tubular shank (28) is removably installed in a channel (25) of the gun grip (18), the other tubular shank (27) in a first channel (10) of the gun barrel (2), each from sides of the gun grip (18) and the gun barrel (2) that border on each other.

17 Claims, 5 Drawing Sheets

Figures 1, 2:
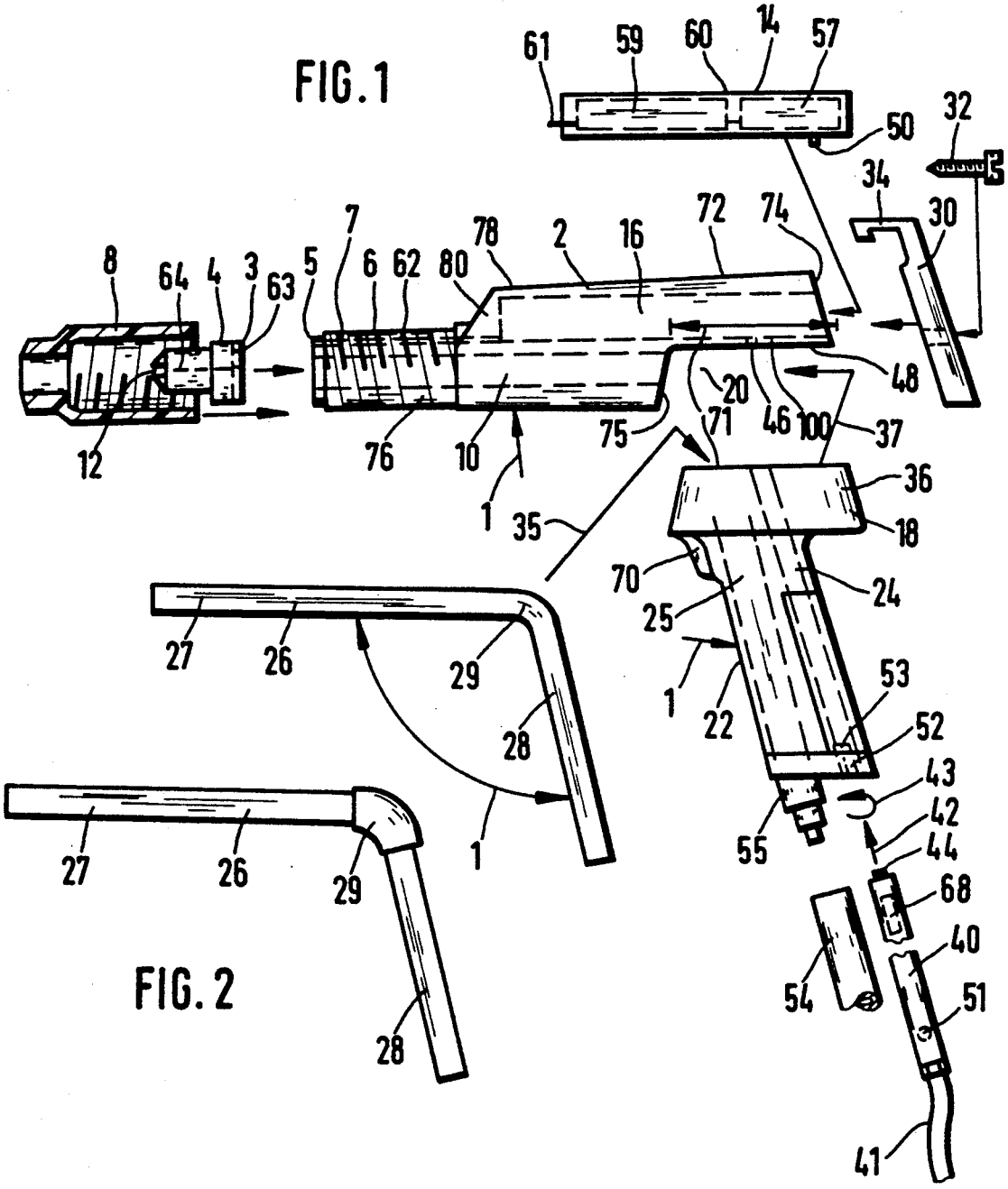

61
59
60
14
57
50
32
34
30
72
74
78
2
16
7
8
64
4
3
63
5
6
62
80
48
20
46
100
37
12
76
10
75
71
1
35
36
18
70
24
25
1
22
53
52
43
42
44
68
40
51
41
54
55
27
26
29
28
1
27
26
29
28

SPRAY GUN FOR ELECTROSTATIC SPRAY COATING

The invention concerns a spray gun for electrostatic spray coating of articles with coating material, specifically coating powder, according to the preamble of claim 1.

Spray guns of that type are known from the U.S. Pat. Nos. 3,617,000, 3,777,981 and 3,844,477. Their fluid line consists of a flexible hose which extends from a coating powder supply up to the spray gun and through it, up to a spray nozzle.

Known from the German patent document No. 28 51 006(=U.S. Pat. No. 4,196,465) is a spray gun which consists of a gun barrel and a carrier in the form of a gun grip fastened on the underside of the barrel. Extending through the gun barrel in the longitudinal direction is a straight channel for feeding powdery coating material to a spray nozzle. Through the channel there extends a straight plastic tube which at the rear protrudes beyond the channel and can be connected to a hose for supplying coating material. Beneath the channel and parallel to it, a second channel extends through the gun barrel. This second channel is forwardly sealed and can rearwardly be sealed as well by means of a cap. With the cap removed, a voltage multiplier cascade, a transformer and an oscillator can be successively introduced into the second channel, these being designed each as a module and connected with each other by means of electrical plugs as the modules are inserted in the second channel. Through the gun grip, from the bottom up, curves a channel through which electrical leads of a voltage supply cable are passed, which at the top protrude out of the gun grip and are connected to a connector plate which can be mated with the plug of the module inserted last. The gun grip can be unscrewed and the gun barrel can then be mounted, without gun grip, on a mechanized carrier, for instance a robot.

The German patent document No. 32 02 945 proposes a voltage multiplier cascade to the secondary side of which there are electrodes connected for electrostatic charging of the coating material. A lamp indicates the electrical voltage of the electrodes. The European patent document No. 0 164 837 B1 proposes a spray gun for liquid coating material with a valve needle within a channel that extends through the gun barrel. The valve needle is actuated by a trigger and interacts with a valve seat which is arranged immediately before the spray nozzle. Here, too, a voltage multiplier cascade serves to generate a high voltage for electrodes for electrostatic charging of the liquid coating material. The European patent document No. 0 110 753 B1 teaches an electrostatic powder spray gun on which grip borders on an overall flat backside of a gun barrel. Contained in the grip is a transformer, and a voltage multiplier is cast into the material of the gun barrel.

The problem underlying the invention is to so design the spray gun that it will enable a simpler manufacture, cleaning maintenance and repair as well as an easy and quick exchange of major elements. Such an exchange of elements not only is intended to shorten operational downtimes in case of defective elements, but is to enable also the changeover of the spray gun from one spray system to another such as known, e.g., from the German patent disclosure No. 36 08 415. Moreover, the invention also is to enable a change of polarity of the high voltage from normally "minus" to "plus", such as required for instance for coating powder from polyamide.

This problem is inventionally solved through the characterizing features of claim 1.

Coating material, specifically powder, has a greatly abrasive effect. Moreover, it is frequently desired to electrostatically charge the powder by friction on the wall of the line. Depending on powder type, other plastic materials are favorable as wall for the line. Inventionally, the tube can be exchanged easily and quickly once it has worn or when it is supposed to consist of a specific plastic or a specific other material or when in the case of a color change there is no time available for cleaning the tube.

The invention achieves a considerable reduction of the channels provided in the gun barrel and also of those in the gun grip. The gun barrel and the gun grip each consist essentially of a plastic body made by injection molding. If the tooling cores needed for the production of the channels in the plastic bodies are long and thin, there is a risk that they will sag during the injection molding process, leading to a deformation of the channels. This disadvantage is inventionally avoided. At the same time, the invention enables the observances of consistent wall thickness of the plastic bodies. The existence of varying wall thicknesses involves the risk that blowholes might form in the cooling process following the injection molding operation. The voltage generator consists of at least one module which in a simple way can be exchanged quickly. Inventionally, the module is accomodated, liquid-tight, in the spray gun barrel so that the gun barrel can be brought in contact with solvent for purposes of cleaning, along with the voltage generator contained in it, without causing damage to the latter. The plastic body into which the components of the voltage generator are cast, therefore, may consist of a plastic different from that of the spray gun barrel and, specifically, the plastic body need not be resistant to solvent. The carrier can be cleaned quickly as well, since the electrical connector of the low-voltage cable can be connected with the connecting elements of the voltage generator on the primary side by simply passing it through a straight-line channel of the carrier. Thus, all electrical connections are simple plug connections. The connector of the electrical feed cable only needs to be pulled out of the carrier for then removing the carrier in a simple way from the spray gun barrel for cleaning.

Further characteristics of the invention are contained in the subclaims.

The invention will be explained hereafter with reference to the drawings with the aid of several embodiments serving as examples.

Figure 3:
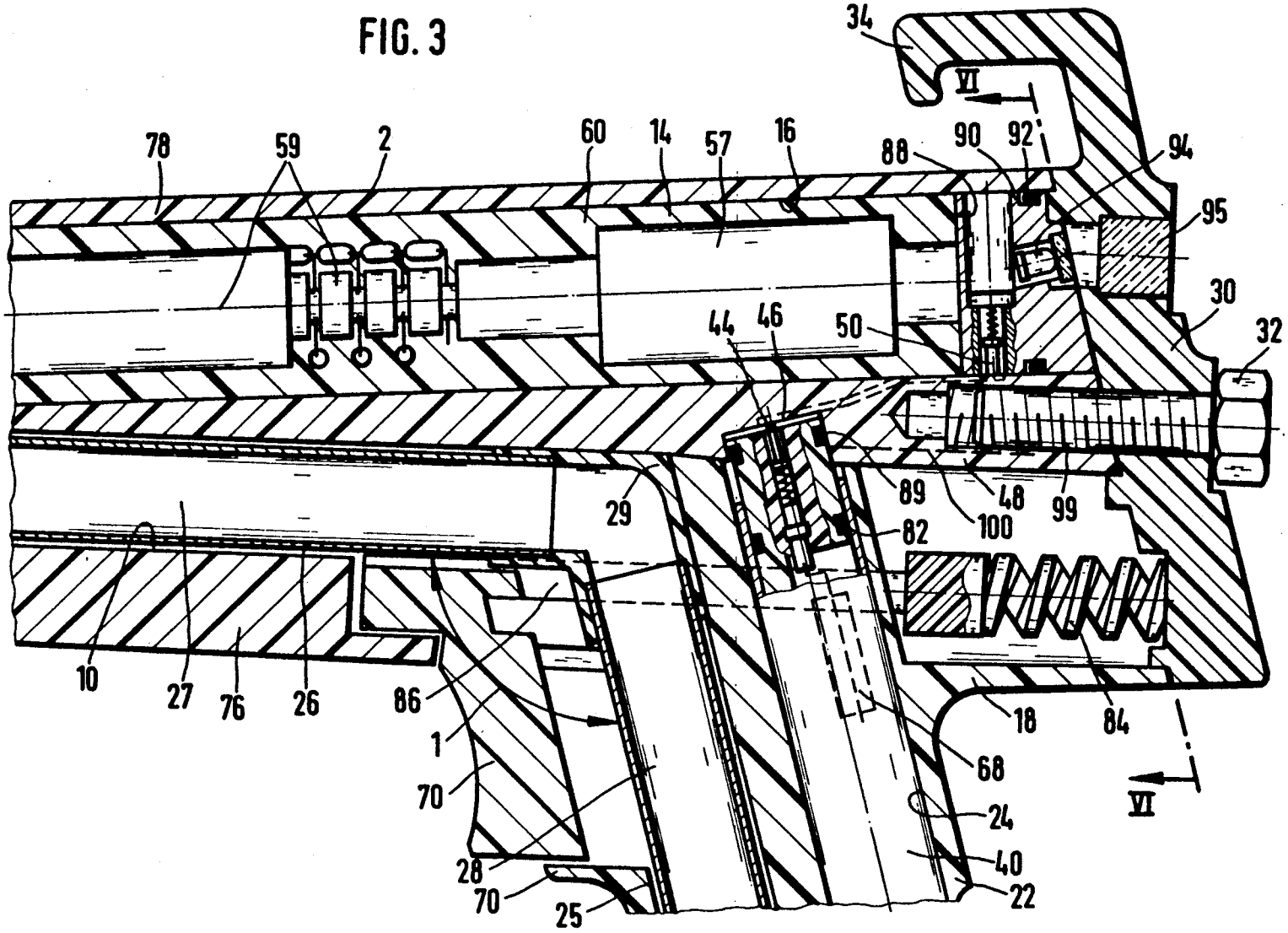
Figure 4:
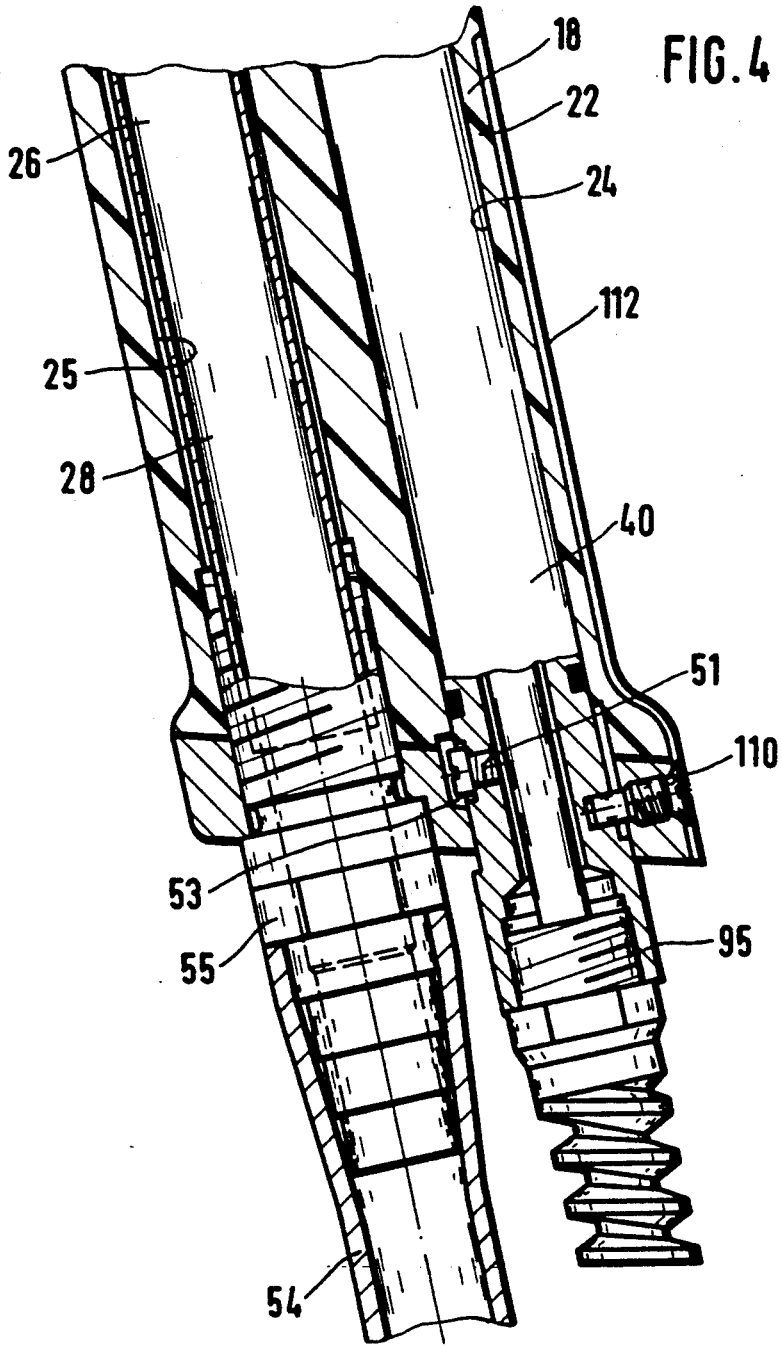
Figure 5:
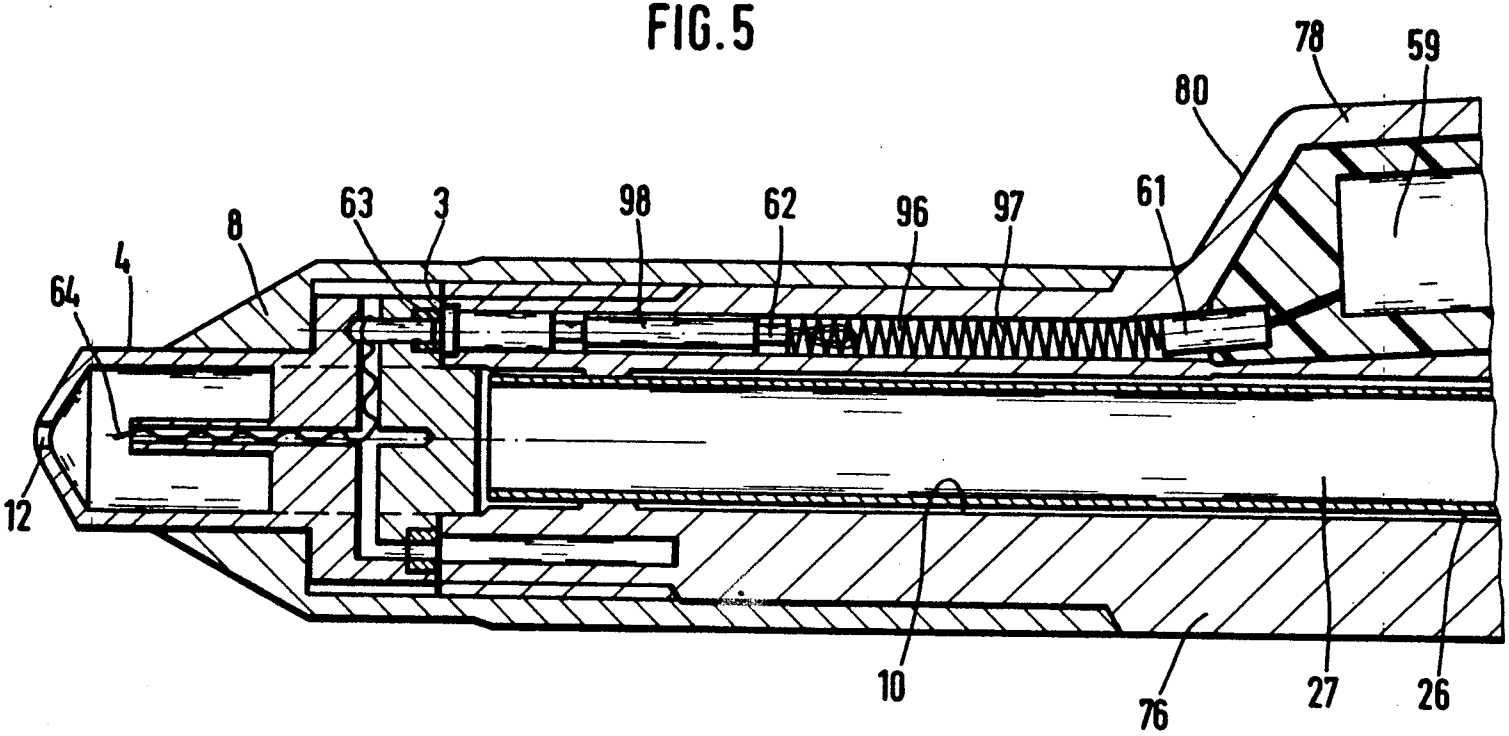
Figure 6:
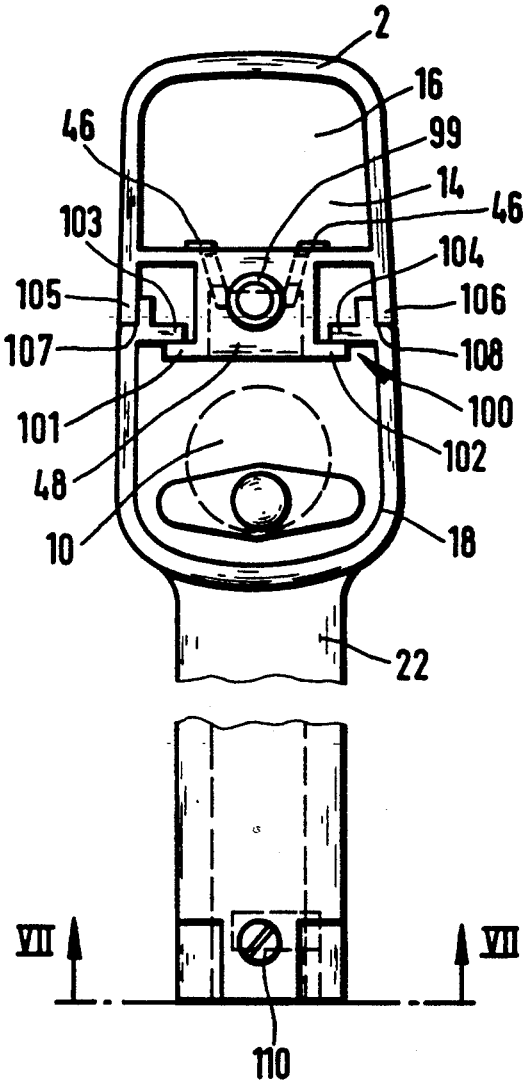
Figure 7:
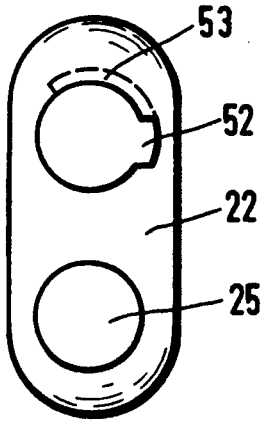

FIG. 1 shows an exploded view of an inventional spray gun;

FIG. 2, another embodiment of a tube according to FIG. 1;

FIG. 3, a longitudinal section, scaled up, of the central part of the spray gun relative to FIG. 1;

FIG. 4, a longitudinal section of the bottom part of a gun grip according to FIG. 1, scaled up the same as FIG. 3;

FIG. 5, a longitudinal section of the front half of the gun barrel relative to FIG. 1, scaled up the same as FIG. 3;

FIG. 6, a rear view along the plane VI—VI in FIG. 3 with a rear cap removed and a voltage generator module removed;

FIG. 7, a view from below, along the plane VII—VII in FIG. 6;

The inventional spray gun for electrostatic spray coating of articles with powdery coating material as illustrated in FIGS. 1 through 7 consists essentially of the following parts: a gun barrel 2 from plastic; a spray nozzle 4 from plastic whose rear, ring-shaped end phase 3 can be forced, airtight, on the forward end face 5 on the front end 6 by screwing a threaded sleeve that fits over the spray nozzle 4 and consists of plastic on the front end 6 of the gun barrel 2 that is provided with a threading 7, with a first straight-line channel 10 being aligned with the nozzle opening 12; a voltage generator 14 having the form of a module and being exchangeably insertable in a second straight-line channel 16 from the rear of the apparatus; a carrier in the form of a gun grip which can be fitted into a recess 20 formed at the bottom rear in the gun barrel 2 and features a grip part 22, with the gun barrel 2 and its grip part 22 made jointly of one piece of plastic, and with a straight-line third channel 24 and parallel with it a straight-line fourth channel 25 extending through the gun grip 18, which two channels extend relative to the straight-line line first channel 10 of the gun barrel 2 at an angle 1 between 90° and 140°; a stiff e.g., plastic, tube 26 extending as powder channel at the same angle as that between the first channel 10 and the fourth channel 25, so that the tube 26 has a shank 27 which essentially extends through the entire channel 10 and a shank 28 extending essentially through the entire length of the fourth channel 25; a rear cover cap 30 that can be fastened by a single screw 32 on the back of the gun barrel 2 and is provided, at the top, with a hook 34 for hanging the spray gun up. The cap 30 and its hook 34 consist integrally of plastic. The parts can be assembled in a simple way by inserting in accordance with arrow 35 the lower shank 28 of the tube 26 in the fourth channel 25 of the gun grip 18, then inserting the forwardly protruding shank 27 of the tube 26, from the gun back, into the first channel, thereby fitting the head part 36 of the gun grip 18 into the recess 20 of the gun barrel 2, according to arrow 37; the voltage generator 14 is fitted from the back of the gun into the second channel 16, with the option of installing the voltage generator 14 before or after the tube 26; next, the rear covering cap 30 is set in place and fastened with the screw 32; then a rod-shaped electrical connector 40 with a low-voltage supply cable 41 is passed, according to arrow 42, through the straight-line third channel 24 and then twisted about 90° according to arrow 43. In the process, electrical contacts 44 on the front end of the rod-shaped connector 40 are automatically forced on electrical connecting elements 46 that are cast in the intermediate bottom 48 of the gun barrel 2. Above the intermediate bottom 48, electrical contacts 50 of the primary side connection of the voltage generator 14 bear on the electrical connecting elements 46. The electrical contacts 44 and 50 have the form of resilient pins. The longitudinal motion 42 and subsequent motion 43 of the connector 40 causes a radially protruding projection 51 of this connector 40 in the third channel 24 to first engage the lengthwise groove 52 and then a groove 53 extending in peripheral direction, through which latter the connector 40 is positioned in the longitudinal direction of the third channel 24. A hose 24 for the feeding of powdery coating material can be connected with a socket 55 of the fourth channel 25. The disassembly of the spray gun relative to FIG. 1 takes place in reverse order and is required, e.g., when the spray gun needs to be cleaned or when the tube 26 is to be exchanged. The voltage generator 14 contains at least a transformer 57 and a voltage multiplier cascade 59, both of which are cast in a block 60 from plastic making the voltage generator 14 an exchangeable module. Fastened on the backside 88 of the block 60, which in FIG. 3 is the right-hand end, is a feed module 90. Electrical contacts 50 for the primary side electrical connection of the voltage generator 14 protrude out of the feed module 90. The voltage generator 14 forms together with the feed module 90 an exchangeable unit. The secondary end of the voltage multiplier cascade 59 is provided with an electrical connecting pin 61. The latter is connected, by way of an electrical line 62 extending through the front part 6 of the gun barrel 2 and by way of a ring-shaped electrical conductor 63 on the rear end face of the spray nozzle 4, with an electrode 64, electrically, which electrode is contained in the spray nozzle 4 and serves to electrostatically charge the powdery coating material. The voltage supplied to the electrical connecting elements 46 can be selectively activated or interrupted by a reed switch 68, which by a trigger 70 on the grip part 22 is magnetically remote-operated. The rear end of the second channel 16 can be hermetically sealed so that no liquid, specifically no solvent can proceed to the second voltage generator 14 housed in this second channel. The second channel 16 and the unit of voltage generator 14 and feed module 90 housed in it extend essentially parallel to the first channel 10, which is arranged underneath, but protrude rearwardly beyond the first channel because the gun barrel 2 is so graduated on its rear end 72, in length, that rearwardly, below the intermediate bottom 48, the recess 20 is located with the second channel 16 extending above the recess 20 up into an upper rearward plane 74, whereas the first channel 10 is located completely within the rearward plane 75 located beneath, which in FIG, 1 defines the left-hand end of the recess 20, the upper boundary of which is the intermediate bottom 48. This makes the first channel 10, which empties in the lower rearward plane 75, about 20% to 50% shorter than what it would be if it extended up into the plane of the upper rearward plane 74. The axial spacing 71 between the two rearward planes 74 and 75 corresponds to the upper axial length of the recess 20 and amounts to between 50% and 300%, preferably 150% of the axial length of the transformer 57. Based on the voltage generator module 14, it can be said that the axial spacing 71 ranges between 30% and 70%, preferably about 50% of the axial length of the voltage generator module 14. The front end of the gun barrel 2 provided with the threading 7 is coaxial with the first channel 10 and has only a minimal diameter, just as large as required for the threading 7 and for accommodating the electrical line 62. This makes the first channel 10 very short requiring only little plastic for forming the spray gun barrel alongside this first channel 10. As a result, no disadvantageous deformations of material are encountered in the manufacture. The lower barrel part forming the first channel 10 and the lower rearward plane 75 as well as the front part 6 with the threading 7 is marked 76. The upper barrel pare 78 located above it extends from the upper rearward plane 74 up to a forward shoulder 80 that tapers into the front end 6 sufficiently far as required for forming the second channel 16 for housing the voltage generator 14 and its feed module 90.

According to the embodiment relative to FIG. 2, the tube 26 may be of a multiple part design. It consists preferably of plastic. The curved section 29 may be an elbow into which tubes are inserted as shanks 27 and 28. According to FIG. 3, the connector 40 of the voltage feed cable 41 has a tubular, electrically insulated sleeve 82 in which the reed switch 68 is accommodated. The trigger 70 moves against the force of a plastic spring 84 a rod-shaped magnet 86 relative to the reed switch 68 thereby turning the switch selectively on or off. The tubular or rod-shaped connector 40 extends up into a blind hole 89 formed in the intermediate bottom 48, thereby preventing the carrier 18 from being separated from the gun barrel 2 as long as the contacts 44 of the connector 40 are in connection with the electrical connecting elements 46 on the primary side of the voltage generator 14. The rear end 95 of the rigid connector 40 extends downwardly out of the grip part 22 according to FIG. 4 so that it can be gripped with the hand. The feed module 90 illustrated in FIG. 3 may be screwed onto the plastic block 60 of the voltage generator 14 or molded to it with plastic. This makes it possible to manufacture the plastic block 60 from a plastic material which is not resistant to solvent, which for casting the transformer 57 and high voltage cascade 59 is more favorable, whereas the feed module 90 consists of a plastic that is resistant to solvent. The feed module comprises a lamp 94 indicating whether an electric voltage is present on the primary side of the voltage generator 14. A seal 92 is provided between the feed module 90 and the shell wall of the second channel 16.

From FIG. 5 it follows that in the electrical line 62 between the voltage generator 14 and the electrode 64 within a fifth channel 96 there are contained an electrically conductive spring 97 and an electrical load limiting resistor 98.

According to FIGS. 3 and 6, the screw 32 of the rear cap 30 is screwed into a threading 99 in the intermediate bottom 48. The screw 32 is made from plastic.

Especially from FIG. 6 it can be seen that between the carrier 18 and the gun barrel 2 a plug connection 100 if formed that extends in the longitudinal direction of the gun barrel. These two parts are axially plugged together at the plug connector as the gun grip 18 is inserted from to left, according to arrow 37 in FIG. 1, into the recess 20 in the gun barrel 2. According to FIG. 6, the plug connection is formed by ribs 101 and 102 of the intermediate bottom 48 which transversely protrude away from each other, by ribs 103 and 104 of the carrier 18 that protrude toward each other and across the ribs 101 and 102, and by wall sections 105 and 106 of the upper barrel section that protrude downward, together with outer shoulders 107 and 108 of the gun grip 18 that extend lengthwise.

FIGS. 6 and 7, in conjuction with FIG. 4, show the quarter-turn catch 51, 52 and 53 of FIG. 1 in greater detail. As can be seen, the projection 51 of the electrical connector 40 may be formed by a screw. Also, the connector 40 may be secured by another screw 110 which at the same time may retain a grounding plate 112 on the back of the grip part 22.

The voltage generator module 14 is set back relative to the rear end, on the lower rearward plane 75 of the first channel 10, sufficiently far so that at least one-half the length of the transformer 57, but preferably the entire transformer 57, will be contained above the recess 20. All of the parts consist of electrically insulating plastic, except for the said electrical components and a grounding plate 112 on the back of the grip part 22 (FIG. 4).

I claim:

1. Spray gun for electrostatic spray coating of articles with coating material, specifically with coating powder, with a fun barrel (2), a gun grip (18) and a fluid line (26) carrying the coating material and extending through channels of the gun grip (18) and of the gun barrel (2) and extending curved at approximately the same angle as the gun grip to the gun barrel, characterized in that the gun grip (18) and the fun barrel (2) are two bodies which are detachably connected with each other, in that the fluid line (26) is a stiff tube with two tubular shanks (27, 28) which at said angle extend obliquely to each other, and in that one tubular shank (28) is removably inserted in a channel (25) of the gun grip (18) while the other tubular shand (27) is removably inserted in a first channel (10) of the gun barrel (2), each from the bordering side of the gun grip (18) and the gun barrel (2), in that the gun barrel (2) includes a rear end (74, 75), in that the rear end (74, 75) of the gun barrel (2) is in its length so graduated that its rear end features at the bottom a recess (20), in that a first channel (10) is located is located in a lower barrel part (76) of the gun barrel (2), which due to the recess is shorter than an upper barrel part (78) of the gun barrel (2), in that a second channel (16) with a voltage generator (14) is located in the upper barrel part (78), which equal to the length of the recess (20) protrudes rearwardly beyond the lower barrel part (76), in that a transformer (57) of the voltage generator (14) with in a second channel (16) extends with at least one-half of its length rearward beyond the first channel (10), in that a part (36) of the gun grip (18) is fitted in the recess (20), of the gun barrel (2), that is situated rearwardly below, in that a third channel (24) extending through the gun grip (18) is straight for receiving an electrical connector (40), and in that connecting elements (46, 50) for electrical connection of a primary side of the voltage generator (14) are relative to an inner end of the third channel (24) so arranged that they will automatically make contact with electrical contacts (44) that are located on the end of the connector (40) away from a voltage supply cable (41), as the connector (40) is passed, from outside, through the third channel (24), for which purpose the connector (40) is rod-shaped and stiff.

2. Spray gun according to claim 1, characterized in that the tube (26) consists of several interconnected parts (27, 28, 29), each made from plastic.

3. Spray gun according to claim 9, characterized in that the gun barrel (2) includes a rear end (74, 75), in that the rear end (74, 75) of the gun barrel (2) is in its length so graduated that its rear end features at the bottom a recess (20)

in that a first channel (10) is located is located in a lower barrel part (76) of the gun barrel (2), which due to the recess is shorter than an upper barrel part (78) of the gun barrel (2), in that a second channel (16) with a voltage generator (14) is located in the upper barrel part (78), which equal to the length of the recess (20) protrudes rearwardly beyond the lower barrel part (76), in that a transformer (57) of the voltage generator (14) with in a second channel (16) extends with at least one-half of its length rearward beyond the first channel (10), in that a part (36) of the gun grip (18) is fitted in the recess (20), of the gun barrel (2), that is situated rearwardly below, in that a third channel (24) extending through the gun grip (18) is straight for receiving an electrical connector (40), and in that connecting elements (46, 50) for electrical connection of a primary side of the voltage generator (14) are relative to an inner end of the third channel (24) so arranged that they will automatically make contact with electrical contacts (44) located on the end of the connector (40) away from a voltage supply cable (41), as the connector (40) is passed, from outside, through the third channel (24), for which purpose the connector (40) is rod-shaped and stiff.

4. Spray gun according to claim 1, characterized in that the gun grip (18) in the third channel (24) is provided with insert/twist/locking means (52, 53) into which the rod type electrical connector (40) in this third channel is inserted in the way of a quarter-turn catch and can then be positioned axially by a partial rotation , with this insert/twist movement at the same time establishing automatically an electrical connection of also the electrical contacts (44) of the connector (40) with the electrical connecting elements (46) leading to the primary side of the voltage generator (14).

5. Spray gun according to claim 8, characterized in that between the gun grip (18) and the gun barrel (2) there is a mating connection (100, FIG. 6) formed that extends in the longitudinal direction of the gun barrel (2) and into which the gun grip (18) can be installed following the prior insertion of the one tubular shank (28), from above down, into the gun grip (18).

6. Spray gun according to one of claims 1, 2, 3, 5, 8, 9 or 10, characterized in that the gun grip (18) features on its bottom end connecting means (55) for connection of a feed line (54) for coating material with the tube (26).

7. Spray gun according to claim 6, characterized in that the rod -shaped electrical connector (40) features a tubular sleeve (82, FIG. 3) from electrically insulating material and that this sleeve (82) houses a magnetically remote-operable reed switch (68) for selective interruption or activation of a control circuit with control relay or of an electrical connection from a cable (41) to electrical contacts (44) of the connector (40).

8. Spray gun or electrostatic spray coating of articles with coating material, specifically with coating powder, with a gun barrel (2), a gun grip (18) and a fluid line (26) carrying the coating material and extending through channels of the gun grip (18) and of the gun barrel (2) and extending curved at approximately the same angle as the gun grip to the gun barrel, characterized in that the gun grip (18) and the gun barrel (2) are two bodies which are detachably connected with each other, in that the fluid line (26) is a stiff tube with two tubular shanks (27, 28) which at said angle extend obliquely to each other, and in that one tubular shank (28) is removably inserted in a channel (25) of the gun grip (18) while the other tubular shank (27) is removably inserted in a first channel (10) of the gun barrel (2), each from the bordering sides of the gun grip (18) and the fun barrel (2), and in that the gun grip (18) has a third channel (24) provided with insert/twist/locking means (52, 53) into which a rod-shaped electrical connector (40) in this third channel is inserted in the way of a quarter-turn catch and can then be positioned axially by a partial rotation, with this insert/twist movement at the same time also establishing automatically an electrical connection of electrical contacts (44) provided by the connector (40) with electrical connecting elements (46) leading to the primary side of a voltage generator (14).

9. Spray gun for electrostatic spray coating of articles with coating material, specifically with coating powder, with a gun barrel (2) a gun grip (18) and a fluid line (26) carrying the coating material and extending through channels of the gun grip (18) and of the gun barrel (2) and extending curved at approximately the same angle as the gun grip to the gun barrel, characterized in that the gun grip (18) and the gun barrel (2) are two bodies which are detachably connected with each other, in that the fluid line (26) is a stiff tube with two tubular shanks (27, 28) which at said angle extend obliquily to each other, and in that one tubular shank (28) is removably inserted in a channel (25) of the gun grip (18) while the other tubular shank (27) is removably inserted in a first channel (10) of the gun barrel (2), each from the bordering sides of the gun grip (18) and the gun barrel (2), and in that between the gun grip (18) and the gun barrel (2) there is a mating connection ( 100, FIG. 6) formed that extends in the longitudinal direction of the gun barrel (2) and into which the gun grip (18) can be installed following the prior insertion of the one tubular shank (28), from above down, into the gun grip (18).

10. Spray gun according to claim 9 characterized in that the tube (26) comprises several interconnected parts (27, 28, 29), each made from plastic.

11. Spray gun according to claim 1, characterized in that the rod-shaped electrical connector (40) features a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to the electrical contacts (44) of the connector (40).

12. Spray gun according to claim 8, characterized in that the rod-shaped electrical connector (40) features a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to a electrical contacts (44) of the connector (40).

13. Spray gun according to claim 9, characterized in that a rod-shaped electrical connector (40) is provided, the rod-shaped electrical connector (40) featuring a tubular sleeve (82, FIG. 3) from electrically insulating material and that this sleeve (82) houses a magnetically remote-operable reed switch (68) for selective interruption or activation of a control circuit with control relay or of an electrical connection from a cable (41) electrical contacts (44) of the connector (40).

14. Spray gun according to claim 10, characterized in that a rod-shaped electrical connector (40) is provided, the rod-shaped electrical connector (40) featuring a tubular sleeve (82, FIG. 3) from electrically insulating material and that this sleeve (82) houses a magnetically remote-operable reed switch (68) for selective interruption or activation of a control circuit with control relay or of an electrical connection from a cable (41) to eletrical contacts (44) of the connector (40).

15. Spray gun according to claim 2, characterized in that a rod-shaped electrical connector (40) is provided, the rod-shaped electrical connector (40) featuring a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to the electrical contacts (44) of the connector (40).

16. Spray gun according to claim 3, characterized in that a rod-shaped electrical connector (40) is provided, the rod-shaped electrical connector (40) featuring a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to the electrical contacts (44) of the connector (40).

17. Spray gun according to claim 5, characterized in that the rod-shaped electrical connector (40) features a tubular sleeve (82, FIG. 3) from electrically insulating material and that this sleeve (82) houses a magnetically remote-operable reed switch reed switch (68) for selective interruption or activation of a control circuit with control relay or of an electrical connection from a cable (41) to the electrical contacts (44) of the connecter (40).

* * * * *